US008660274B2

(12) United States Patent
Wolff et al.

(10) Patent No.: US 8,660,274 B2
(45) Date of Patent: Feb. 25, 2014

(54) BEAMFORMING PRE-PROCESSING FOR SPEAKER LOCALIZATION

(75) Inventors: Tobias Wolff, Neu-Ulm (DE); Markus Buck, Biberach (DE); Gerhard Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 1091 days.

(21) Appl. No.: 12/504,333

(22) Filed: Jul. 16, 2009

(65) Prior Publication Data

US 2010/0014690 A1 Jan. 21, 2010

(30) Foreign Application Priority Data

Jul. 16, 2008 (EP) ..... 08012866

(51) Int. Cl.
*H04R 3/00* (2006.01)

(52) U.S. Cl.
USPC ..... 381/92

(58) Field of Classification Search
USPC ..... 381/92
See application file for complete search history.

(56) References Cited

U.S. PATENT DOCUMENTS 5,208,864 A * 5/1993 Kaneda ..... 704/258

FOREIGN PATENT DOCUMENTS

| | | | | |
|---|---|---|---|---|
| EP | 1 727 344 A2 | 11/2006 | ..... | H04M 9/08 |
| EP | 1923866 A1 * | 5/2008 | | |
| EP | 1 933 303 B1 | 6/2008 | ..... | G10L 15/22 |
| WO | WO 2008/041878 A2 | 4/2008 | | |
| WO | WO 2008/041878 A3 | 4/2008 | ..... | G01S 3/00 |

OTHER PUBLICATIONS

Amand, F. et al., "A Fast Two-Channel Projection Algorithm for Stereophonic Acoustic Echo Cancellation," *IEEE International Conference on Acoustics, Speech, and Signal Processing Conference Proceedings*, vol. 2, May 7, 1996, pp. 949-952.

Chapman, D.J., "Partial Adaptivity for the Large Array," *IEEE Transactions on Antennas and Propagation*, vol. AP-24, No. 5, Sep. 1976, pp. 685-696.

Hansler, E. et al., "Acoustic Echo and Noise Control," *John Wiley & Sons*, Inc., 2004.

European Patent Office, European Search Report, Application No. 08012866.3-2225; Nov. 12, 2008.

Gannot, S., et al., "Beamforming Methods for Multi-Channel Speech Enhancement," *IIWAENC*, 1999, pp. 96-99.

Griffiths, L., et al., "An Alternative Approach to Linearly Constrained Adaptive Beamforming," *IEEE Transactions on Antennas and Propagation*, vol. AP-30, No. 1, Jan. 1982, pp. 27-34.

(Continued)

*Primary Examiner* — Duc Nguyen
*Assistant Examiner* — Kile Blair
(74) *Attorney, Agent, or Firm* — Daly, Crowley, Mofford & Durkee, LLP

(57) ABSTRACT

Embodiments of the present invention relate to methods, systems, and computer program products for signal processing. A first plurality of microphone signals is obtained by a first microphone array. A second plurality of microphone signals is obtained by a second microphone array different from the first microphone array. The first plurality of microphone signals is beamformed by a first beamformer comprising beamforming weights to obtain a first beamformed signal. The second plurality of microphone signals is beamformed by a second beamformer comprising the same beamforming weights as the first beamformer to obtain a second beamformed signal. The beamforming weights are adjusted such that the power density of echo components and/or noise components present in the first and second plurality of microphone signals is substantially reduced.

12 Claims, 2 Drawing Sheets

(56) References Cited

OTHER PUBLICATIONS

Herbordt, W, et al., "Computationally Efficient Frequency-Domain Robust Generalized Sidelobe Canceller," *Multimedia Signal Processing, 2001 IEEE Fourth Workshop* on Oct. 3-5, 2001; 4 pages.

Hoshuyama, O., et al., "A Robust Adaptive Beamformer for Microphone Arrays with a Blocking Matrix Using Constrained Adaptive Filters," IEEE Transactions on Signal Processing, vol. 47, No. 10, Oct. 1999, pp. 2677-2684.

Lombard, A., et al., "Multichannel Cross-Talk Cancellation in a Call-Center Scenario Using Frequency-Domain Adaptive Filtering," *Proceedings of the 11th International Workshop on Acoustic Echo and Noise Control*, Seattle, Washington, Sep. 2008, pp. 14-17.

Van Veen, B., et al., "Beamforming: A Versatile Approach to Spatial Filtering," *IEEE ASSP Magazine*, Apr. 1988, pp. 4-24.

Warsitz, E., et al., "Blind Acoustic Beamforming Based on Generalized Eigenvalue Decomposition," *IEEE Transactions on Audio, Speech and Language Processing*, vol. 15, No. 5, Jul. 2007, pp. 1529-1539.

Widrow, B., et al., "Adaptive Noise Cancelling: Principles and Applications," *Proceedings of the IEEE*, vol. 63, No. 12, Dec. 1975, pp. 1692-1717.

Wolff, T., et al., "A Subband Based Acoustic Source Localization System for Reverberant Environments," *Harman/Becker Automotive Systems, Acoustic Signal Processing Research*, 4 pages, Oct. 2008.

* cited by examiner

BEAMFORMING PRE-PROCESSING FOR SPEAKER LOCALIZATION

PRIORITY

The present U.S. patent application claims priority from European Patent Application No. 08012866.3 entitled Beamforming Pre-Processing for Speaker Localization filed on Jul. 16, 2008, which is incorporated herein by reference in its entirety.

TECHNICAL FIELD

The present invention relates to the localization of speakers, in particular, speakers communicating with remote parties by means of hands-free sets or speakers using a speech control or speech recognition means comprised in some communication means. Particularly, the present invention relates to the localization of a speaker including pre-processing of microphone signals by beamforming.

BACKGROUND ART

The localization of one or more speakers (communication parties) is of importance in the context of many different electronically mediated communication situations where multiple microphones, e.g., microphone arrays or distributed microphones are utilized. For example, the intelligibility of speech signals that represent utterances of users of hands free sets and are transmitted to a remote party heavily depends on an accurate localization of the speaker. If accurate localization of a near end speaker fails, the transmitted speech signal exhibits a low signal-to-noise ratio (SNR) and may even be dominated by some undesired perturbation caused by some noise source located in the vicinity of the speaker or in the same room in which the speaker uses the hands-free set.

Audio and video conferences represent other examples in which accurate localization of the speaker(s) is mandatory for a successful communication between near and remote parties. The quality of sound captured by an audio conferencing system, i.e. the ability to pick up voices and other relevant audio signals with great clarity while eliminating irrelevant background noise (e.g. air conditioning system or localized perturbation sources) can be improved by a directionality of the voice pick up means.

In the context of speech recognition and speech control the localization of a speaker is of importance in order to provide the speech recognition means with speech signals exhibiting a high signal-to-noise ratio, since otherwise the recognition results are not sufficiently reliable.

Acoustic localization of a speaker is usually based on the detection of transit time differences of sound waves representing the speaker's utterances by means of multiple (at least two) microphones. However, in the art methods for the localization of a speaker are error-prone in acoustic rooms that exhibit a significant reverberation and, in particular, in the context of communication systems providing audio output by some loudspeakers. In order to avoid erroneous speaker localization due to acoustic loudspeaker outputs echo compensation filtering means are usually employed in order to preprocess the microphone signals used for the speaker localization.

Echo compensation by filtering means allow for the reduction of echo components, in particular, due to loudspeaker outputs, by estimating echo components of the impulse response and adapting filter coefficients in order to suppress the echo components. However, echo suppression by multichannel echo compensating filters and, particularly, the control of the adaptation of the respective filter coefficients demands for relatively powerful computer resources and results in heavy processor load. Moreover, inefficient echo compensating still results in erroneous speaker localization. Therefore, there is a need for a method for a more reliable localization of a speaker without the demand for powerful computer resources.

SUMMARY OF THE INVENTION

Embodiments of the present invention are directed to systems, methods and computer program products related to signal processing that can be used as pre-processing in a procedure for the localization of a speaker (speaking person) in a room in that at least one loudspeaker and at least one microphone array are located. The one embodiment of the method for signal processing requires obtaining a first plurality of microphone signals from a first microphone array and obtaining a second plurality of microphone signals from a second microphone array different from the first microphone array. The first plurality of microphone signals is beamformed by a first beamformer comprising beamforming weights to obtain a first beamformed signal. The second plurality of microphone signals is beamformed by a second beamformer comprising the same beamforming weights as the first beamformer to obtain a second beamformed signal. The beamforming weights are then adjusted (adapted) such that the power density of echo components and/or noise components present in the first and second plurality of microphone signals is minimized.

In different embodiments the beamforming weights may be adjusted such that the power density of the sum of the first and the second beamformed signals is substantially reduced. In yet other embodiments, the beamforming weights may be adjusted such that the power density of the first beamformed signal and the power density of the second beamformed signal are substantially reduced. The beamforming weights may be adjusted using non-linear least mean square algorithm observing the condition that the L2 norm of the vector of the beamforming weights is greater than zero. In other embodiments, the beamforming weights are adjusted by a non linear least mean square algorithm observing the condition that the power transfer function of the first and the second beamformers for a predetermined frequency range and a predetermined range of spatial angles does not fall below a predetermined limit.

The first and the second microphone arrays may be subarrays of a third microphone array and the first and second plurality of microphone signals are selected from a third plurality of microphone signals obtained by the third microphone array. In particular, the first plurality of microphone signals comprises at least one microphone signal of the second plurality of microphone signals. The methodology may be used to determine the speaker's direction towards and/or distance from the first and/or second microphone arrays on the basis of the first and/or second beamformed signals.

The system may include a plurality of microphone arrays along with a control means for adjusting the beamforming weights of the beamformers. The first and second beamformers may be adaptive filter-and-sum beamformers, linearly constrained minimum variance beamformers, minimum variance distortionless response beamformers, and/or differential beamformers.

DETAILED DESCRIPTION

Figure 2:
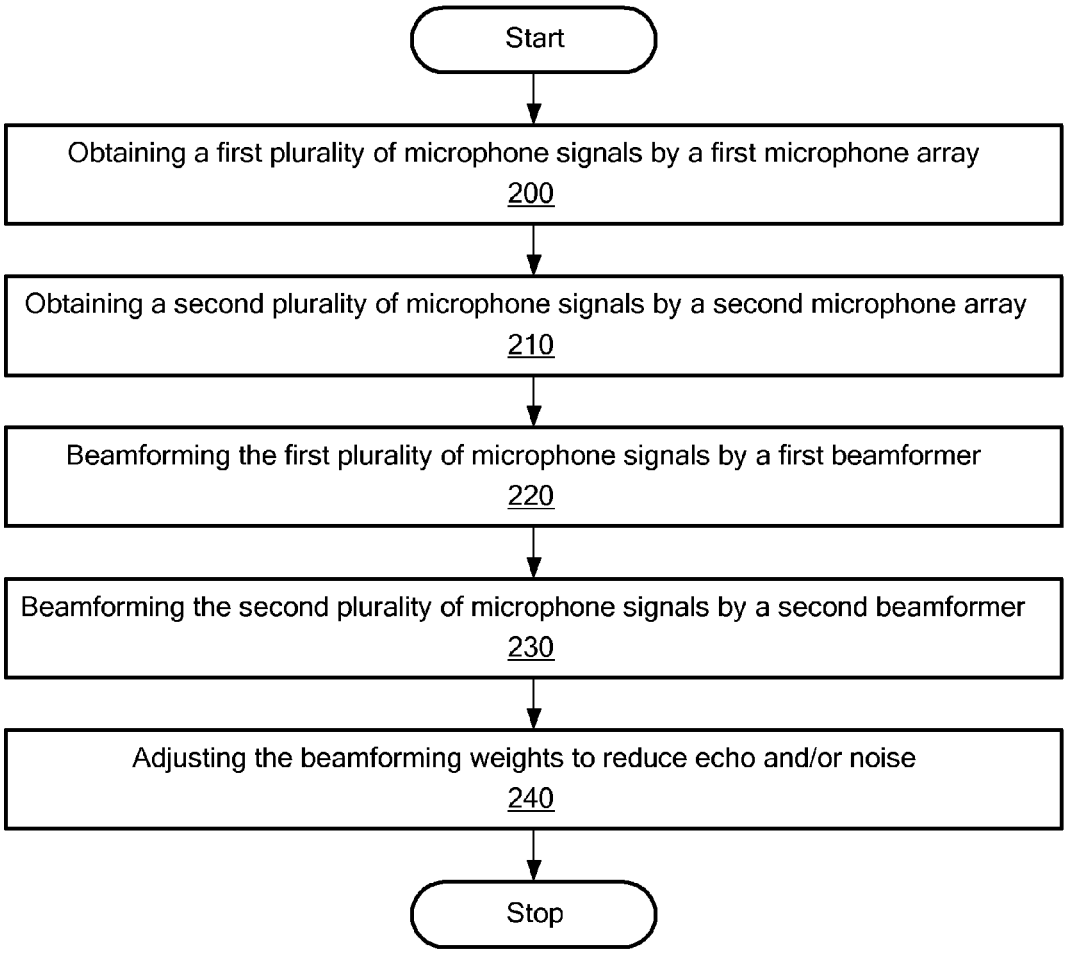
FIG. 2 is a flowchart of a methodology for adjusting beamforming parameters to reduce noise and echo.

The present invention as embodied in the detailed description, figures and claims relates to signal processing and signal processing systems that can be used for pre-processing signals in a procedure for the localization of a speaker (speaking person) in a room in that at least one loudspeaker and at least one microphone array are located. The methodology provides for increasing the signal to noise ration by reducing noise and echo. The system and methodology employs beamformers that have adjustable beamforming weights. The flow chart of FIG. 2 explains the methodology for adjusting beamforming parameters for the reduction of noise and echo. A first plurality of microphone signals from a first microphone array is obtained 200. A second plurality of microphone signals from a second microphone array different from the first microphone array is also obtained. 210 The first plurality of microphone signals is beamformed by a first beamformer comprising beamforming weights to obtain a first beamformed signal. 220 The second plurality of microphone signals is beamformed by a second beamformer comprising the same beamforming weights as the first beamformer to obtain a second beamformed signal. 230 The beamforming weights are then adjusted (adapted) such that the power density of echo components and/or noise components present in the first and second plurality of microphone signals is minimized. 240

The operation of beamformers per se is well-known in the art (see, E. Hänsler and G. Schmidt, "Acoustic Echo and Noise Control: A Practical Approach", Wiley IEEE Press, New York, N.Y., USA, 2004). In the present invention, the first and second beamformers can be chosen from the group consisting of an adaptive filter-and-sum beamformer, a Linearly Constrained Minimum Variance beamformer, e.g., a Minimum Variance Distortionless Response beamformer and a differential beamformer.

The Linearly Constrained Minimum Variance beamformer can be advantageously used to account for a distortion-free transfer in a particular direction. Moreover, it can account for so-called "derivative constraints" including constraints on derivations of the directional characteristic of the beamformer. The differential beamformer allows for the formation of hard/highly localized spatial nullings in particular directions, e.g., in the directions of one or more loudspeakers.

The method can be generalized to more than two microphone arrays and more than two beamformers in a straightforward way. In this case N>2 microphone arrays to obtain N pluralities of microphone signals and N beamformer are employed and the beamforming weights (filter coefficients) of the N beamformers are adjusted such that power density of echo components and/or noise components present in the N pluralities of microphone signals is minimized. The beamformers are not necessarily realized in form of separate physical units.

The first and second beamformers are adapted such that echo/noise present in the microphone signals is minimized and the thus enhanced beamformed microphone signals can be used for any kind of speaker localization known in the art. For instance, the beamformed signals can be input into a speaker localization means that estimates the cross power density spectrum of the beamformed signals by spatial averaging after Fast Fourier transformation of these signals. After Inverse Fourier transformation of the estimated cross power density spectrum the cross correlation function is obtained. The location of the maximum of the cross correlation function is indicative for the inclination direction of the sound detected by the microphone arrays.

Since the beamformers are adapted in order to reduce the echo/noise components, a downstream processing for speaker localization is more reliable in the art, since perturbations that might lead to misinterpretations of the direction of a speaker with respect to the microphone arrays are significantly reduced. In particular, echo components, e.g., caused by loudspeaker outputs of loudspeakers installed in the same room as the microphone arrays are suppressed without the need for echo compensation filtering means that are conventionally employed in order to enhance the reliability of speaker localization and that are very expensive in terms of processing load.

According to an embodiment of the inventive method the beamforming weights (filter coefficients of the first and second beamformers) are adjusted (adapted) such that the power density of the sum of the first and the second beamformed signals (or N beam-formed signals) is minimized. According to an alternative embodiment the beamforming weights are adjusted such that the sum of the power density of the first beam-formed signal and the power density of the second beamformed signal (sum of the power density of N beamformed signals) is minimized. Both alternatives provide an efficient and reliable way to minimize echo/noise components that are present in the microphone signals detected by the first and second microphone arrays before beam-forming.

Adaptation of the beamforming weights can be achieved by any method known in the art. For instance, a Normalized Least Mean Square algorithm can be used for the adaptation of the beamformers (beamforming weights). The Non-Linear Least Mean Square algorithm may particularly be employed observing the condition that the L2 norm of the vector of the beamforming weights is greater than zero. This condition guarantees that the Non-Linear Least Mean Square algorithm does not find (and be fixed to) the trivial solution of vanishing beamforming weights.

Moreover, the beamforming weights of the first and second beamformer may be adjusted by a Non Linear Least Mean Square algorithm observing the condition that the power transfer function of the first and the second beamformers for a predetermined frequency range and a predetermined range of spatial angles does not fall below a predetermined limit. Thereby, it is avoided that output signals of the employed beam-formers approximate zero which would result in a sharp blinding out of particular directions/inclinations of sound which possibly would undesirably affect subsequent processing of the output signals of the beamformers for speaker localization.

The first and the second microphone arrays can represent different sub-arrays of a third larger microphone array and the first and second plurality of microphone signals can be selected from a third plurality of microphone signals obtained by the third microphone array. In particular, the first plurality of microphone signals comprises at least one microphone signal of the second plurality of microphone signals.

The sub-arrays can, e.g., be chosen such that the distance between centers of the sub-arrays is maximized. Thereby, it is achieved that the output signals of the beam-former show a maximum phase difference. In particular, it shall be avoided that the centers of the selected sub-arrays overlap each other.

As already stated the herein disclosed method for signal processing can be used as a pre-processing step within speaker localization. Thus, it is provided a method for the localization of a speaker, wherein the method comprises the steps of the method for signal processing according to one of the above-described examples and wherein the method further comprises the determination of the speaker's direction towards and/or distance from the first and/or second microphone arrays on the basis of the first and/or second beamformed signals. Acoustic localization of a speaker can be performed on the basis of the beamformed signals by any means known in the art. It can be performed is based on the detection of transit time differences of sound waves representing the speaker's utterances.

The above-examples of the method for signal processing can be used before actual operation of a communication means that comprises a means for the localization of a speaker. The means for the localization of a speaker can be calibrated by adaptation of the beamforming weights of the first and second beamformers. The calibration is carried out with no wanted signal present (see detailed description below) In the subsequent operation of the communication means the beamforming weights (optimized for echo/noise reduction) are maintained without alteration and, thus, speaker localization is improved, since the first and second beamformers provide the means for the localization of a speaker with enhanced signals. Thus, it is provided a method for calibrating a means for the localization of a speaker comprised in a communication system that further comprises at least one loudspeaker and at least two microphone arrays, the method comprising the steps of:

outputting a noise signal by the at least one loudspeaker;

detecting an audio signal comprising the noise signal by the first microphone array to obtain a first plurality of microphone signals and detecting the audio signal by the second microphone array to obtain a second plurality of microphone signals;

beamforming the first plurality of microphone signals by a first beamformer comprising beamforming weights to obtain a first beamformed signal;

beamforming the second plurality of microphone signals by a second beamformer comprising the same beamforming weights as the first beamformer to obtain a second beamformed signal;

wherein the beamforming weights are adjusted such that the power density of echo components and/or noise components present in the first and/or second plurality of microphone signals is minimized; and storing and fixing the adjusted weights to calibrate the means for localization of a speaker.

In order to guarantee the most reliable calibration possible it may be determined whether speech of a local speaker (speaker that is present in the same room in that the first and second microphone arrays are installed) is present in the audio signal; and the steps of beamforming the first plurality of microphone signals by a first beamformer comprising beamforming weights to obtain a first beamformed signal;

beamforming the second plurality of microphone signals by a second beamformer comprising the same beamforming weights as the first beamformer to obtain a second beamformed signal;

wherein the beamforming weights are adjusted such that the power density of echo components and/or noise components present in the first and/or second plurality of microphone signals is minimized; and storing and fixing the adjusted weights to calibrate the means for localization of a speaker;

may only be performed, if it is determined that no speech of a local speaker is present in the audio signal. If according to this example, it is determined that speech of a local speaker is present in the audio signal no adjustment (adaptation) of the beamforming weights for calibration of the means for speaker localization is performed.

It should also be noted that the adjustment of the beamforming weights in all of the above-described embodiments of the herein disclosed method for signal processing shall only be performed, if speech is actually detected in order to avoid maladjustment. Means for the detection of speech of a local speaker are well-known and may rely on signal analysis with respect to speech features as pitch, spectral envelope, phoneme extraction, etc.

The above-described methods of minimizing the power density of echo components and/or noise components present in the first and/or second plurality of microphone signals can also be used in the method for calibrating a means for the localization of a speaker comprised in a communication system.

Furthermore, the present invention provides a signal processing means, comprising:

a first microphone array configured to obtain a first plurality of microphone signals;

a second microphone array different from the first microphone array and configured to obtain a second plurality of microphone signals;

a first beamformer comprising beamforming weights and configured to beamform the first plurality of microphone signals to obtain a first beamformed signal;

a second beamformer comprising the same beamforming weights as the first beam-former and configured to beamform the second plurality of microphone signals to obtain a second beamformed signal; and a control means configured to adjust the beamforming weights such that the power density of echo components and/or noise components present in the first and/or second plurality of microphone signals is minimized.

The control means of the signal processing means may be is configured to adjust the beamforming weights by minimizing the power density of the sum of the first and the second beamformed signals or by minimizing the sum of the power density of the first beamformed signal and the power density of the second beamformed signal.

The first and second beamformers of the signal processing means can be chosen from the group consisting of an adaptive filter-and-sum beamformer, a Linearly Constrained Minimum Variance beamformer, a Minimum Variance Distortionless Response beamformer and a differential beamformer.

Furthermore, it is provided a communication system that is adapted for the localization of a speaker and comprises the signal processing means according to one of the above examples;

at least one loudspeaker configured to output sound that is detected by the first and second microphone arrays of the signal processing means of one of the above examples; and a processing means configured to determine the speaker's direction towards and/or distance from the first and/or second microphone arrays on the basis of the first and/or second beamformed signals.

The above-mentioned examples of a signal processing means provided in the present invention can advantageously be used in a variety of communication devices. In particular, it is provided a handsfree set, comprising the signal processing means according to one of the above examples or the above-mentioned communication system.

In addition, it is provided an audio or video conference system, comprising the signal processing means according to one of the above examples or the above-mentioned communication system.

Improved speaker localization facilitated by the herein disclosed pre-processing for minimizing the power density of perturbations, in particular, echoes caused by loudspeaker outputs, is advantageous in the context of machine-based speech recognition. Thus, it is provided a speech control means or speech recognition means comprising the signal processing means to one of the above examples or the above-mentioned communication system.

Additional features and advantages of the present invention will be described with reference to the drawing. In the description, reference is made to the accompanying figure that is meant to illustrate preferred embodiments of the invention. It is understood that such embodiments do not represent the full scope of the invention.

Figure 1:
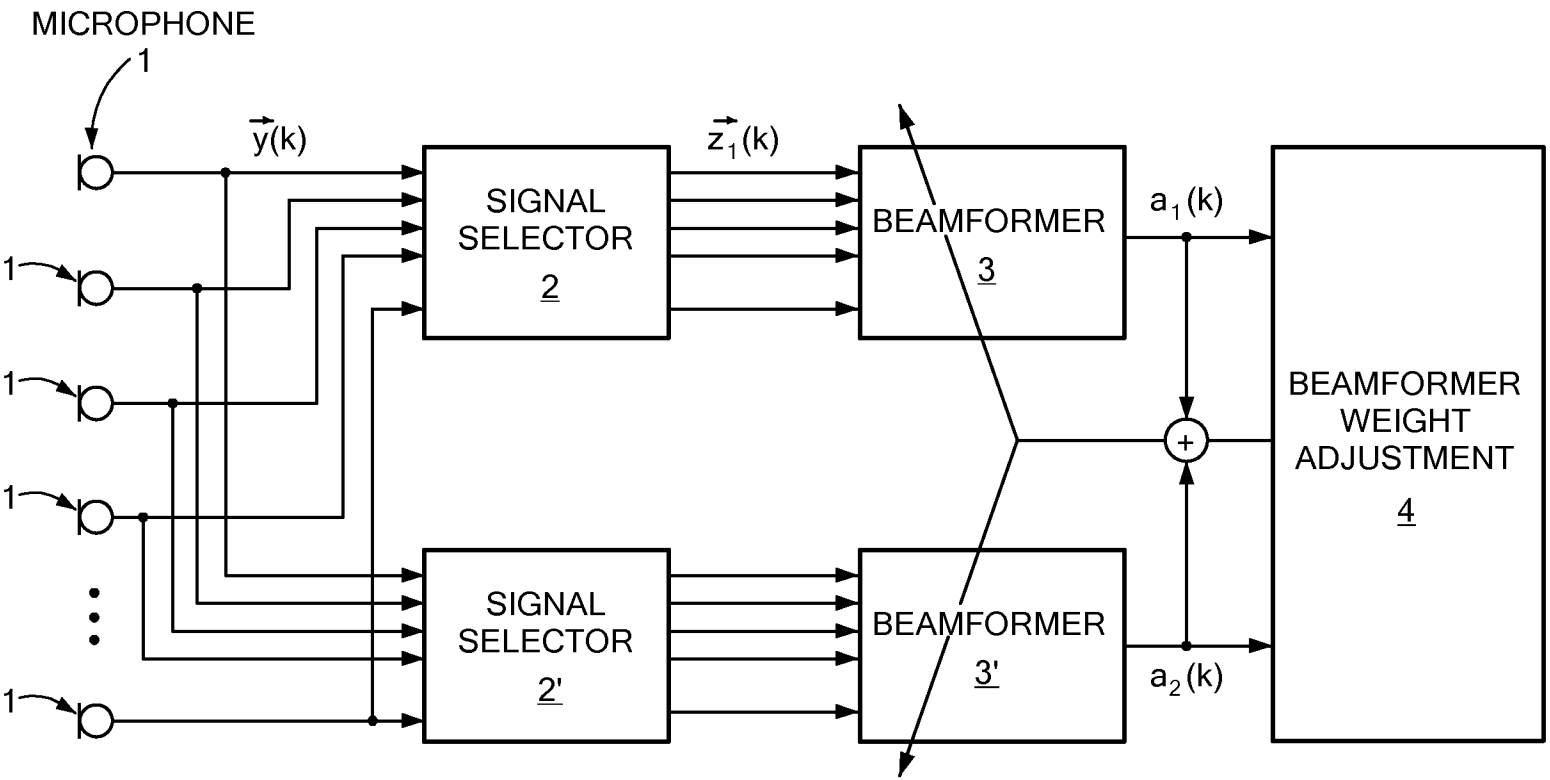
FIG. 1 shows a communication system for implementing embodiments of the present invention for determining and adapting beamforming weights for speaker localization.

FIG. 1 illustrates an example of the signal processing of microphone signals according to the present invention.

In the present invention signal processing of microphone signals is performed in order to obtain enhanced signals that can subsequently be used for speaker localization. In the shown example, a number of microphones 1 is installed, e.g., in a closed room as a living room or a vehicle compartment. The microphones 1 are arranged in an aggregate microphone array and detect acoustic signals in the room and obtain microphone signals $\vec{y}(k):=(y_1(k), \ldots, y_m(k), \ldots, y_M(k))^T$ where the upper index T denotes the transposition operation. From these M microphone signals two sub-groups corresponding to a first and a second microphone array comprised in the aggregate microphone array are selected by selection means 2 and 2' that employ selection matrices $P_1$ and $P_2$ of dimension L×M $$\vec{z}_1(k)=P_1\cdot\vec{y}(k)$$

$$\vec{z}_2(k)=P_2\vec{y}(k)$$

with the matrix elements $$P_{j,l,m} \in \{0, 1\}, \sum_{m=1}^{M} P_{j,l,m} = 1$$

As can be seen in FIG. 1 some of the M microphones belong to both the first and the second selected group of microphones (microphone array), i.e. each of the microphone signals $\vec{y}(k)$ is transmitted to an output of at least either selection means 2 or 2' and some of the microphone signals are transmitted to both the output of selection means 2 and the one of selection means 2'. The selection means may be a multiplexor.

When the microphones 1 are arranged in an equidistant manner the relation $$P_{1,l,m}=P_{2,l,m+d}, d\neq 0$$

holds. If, for example, an aggregate microphone array with M=6 microphones is used and four output microphone signals are to be obtained at the outputs of the selections means 2 and 2', this can be achieved by $$P_1\begin{pmatrix}100000\\010000\\001000\\000100\end{pmatrix} \text{ and}$$

-continued $$P_2\begin{pmatrix}001000\\000100\\000010\\000001\end{pmatrix}.$$

It is noted that processing can, in particular, be performed in the subband frequency regime. In this case, the selection matrices can be chosen differently for some or each of the sub-bands.

As shown in FIG. 1 the output signals $\vec{z}_1(k)$ of the first selection means 2 and the output signals $\vec{z}_2(k)$ of the second selection means 2' are input in a first beamformer 3 and a second beamformer 3', respectively. Both beamformers 3 and 3' comprise the same beamforming weights (filter coefficients)

$$\vec{\omega}(k)=[\vec{\omega}_0{}^T(k), \vec{\omega}_n{}^T(k), \ldots, \vec{\omega}_{N_{bf}-1}{}^T(k)]^T$$

with $$\vec{\omega}_n(k)=[\omega_{l,n}(k), \ldots, \omega_{l,n}(k), \ldots, \omega_{l,n}(k)]^T,$$

wherein $N_{bf}$ denotes the filter length of the beamformers 3 and 3'. By the beamforming processing, output signals $a_1(k)$ and $a_2(k)$ are obtained $$a_1(k)=(\vec{\omega}^H(k)\cdot\vec{z}_1(k) \text{ and } a_2(k)=(\vec{\omega}^H(k)\cdot(\vec{z}_2(k).$$

Once more, it is noted that according to the present invention $\vec{z}_1(k)$ and $\vec{z}_2(k)$ are subject to the same beamforming process employing the same beamforming weights.

The audio signals detected by the microphones 1 and, thus, the microphone signals, in general, comprise wanted contributions and perturbation contributions. The wanted contributions may, in particular, correspond to the utterance of a speaker in the room in which the microphones 1 are installed. The perturbation contributions may, in particular, comprise echo components caused by a loudspeaker output of one or more loudspeakers (not shown) that are installed in the same room as the microphones 1.

The beamforming weights are adjusted such that the perturbation contributions are minimized. This means that the signal processing according to the present invention has to be performed for audio signals that do not comprise a wanted contribution. Either the adaptation of the beamformers 3 and 3' has to be performed before the actual usage of a communication means comprising a means for speaker localization (offline) or, if the adaptation is performed during the operation of a communication means comprising a speaker localization means, i.e. on-line, the beamforming weights have to be adjusted (adapted) during speech pauses. In this case, some speech detection means and some control means 4 have to be employed wherein the control means 4 allows for adaptation of the beamforming weights of the beamformers 3 and 3' adjusted during speech pauses only.

At least two alternative methods for realizing the minimization of the perturbation components in the output signals $a_1(k)$ and $a_2(k)$ of the first and second beamformer 3, 3' are provided herein. According to the first alternative, the power density of the sum of the outputs $a_1(k)$ and $a_2(k)$ is minimized $$E\{(a_1(k)+a_2(k))\cdot(a_1(k)+a_2(k))^*\}\rightarrow\text{min}.$$

Wherein the asterisk denotes the complex conjugate. According to the second alternative, the sum of the power densities is minimized $$E\{a_1(k)\cdot a_1(k)^*+a_2(k)\cdot a_2(k)^*\}\rightarrow\min$$

Adaptation of the beamforming weights can be performed by means of the Non-Linear Least Mean Square algorithm that is well-known in the art (see, E. Hänsler and G. Schmidt, "Acoustic Echo and Noise Control: A Practical Approach", Wiley IEEE Press, New York, N.Y., USA, 2004) and provides a robust and relatively fast means for adaptation. However, it has to be prevented that the algorithm finds the trivial solution $\vec{\omega}(k)=0$. This can be achieved, for instance, by applying the condition that the L2 norm of the vector $\vec{\omega}(k)=0$ has to be positive $\|\vec{\omega}(k)\|^2>0$. This can be realized by normalizing the beamforming weights to the vector norm after each adaptation step:

$$\tilde{\vec{\omega}}(k+1)=\vec{\omega}(k)+\mu\frac{(\vec{z}_1(k)+\vec{z}_2(k))\cdot(a_1(k)+a_2(k))^*}{\|\vec{z}_1(k)+\vec{z}_2(k)\|^2}$$

$$\vec{\omega}(k+1)=\frac{\tilde{\vec{\omega}}(k+1)}{\left\|\tilde{\vec{\omega}}(k+1)\right\|}.$$

Furthermore, it should be guaranteed that the output signals $a_1(k)$ and $a_2(k)$ are not minimized to zero (or almost zero) thereby causing the beamformer to suppress any signal energy of the corresponding particular direction which implies that subsequent speaker localization would not receive any information from that direction. This would possibly affect the reliability of the speaker localization. Therefore, the adaptation of the beamforming weights of the beamformers 3 and 3' might be performed under the condition $$\|H_\omega(f,\theta)\|^2\geq\epsilon,$$

wherein H is the power transfer function of the first and second beamformer 3 and 3' depending on the frequency f and the spatial angle θ within a predetermined range and wherein ϵ denotes a predetermined lower limit.

As already mentioned the adaptation of the beamformers 3 and 3' might be performed before an actual usage of a communication means in order to calibrate a means for speaker localization comprised in the communication means. For example, a means for speaker localization of a speech recognition means may be calibrated by means of a specially designed user dialog during which the position/direction of loudspeakers relative to a microphone array can be determined. Additionally, by the user dialog the above-mentioned predetermined range of spatial angle can be fixed. According to another example, (white) noise may be output by one or more loudspeakers and the beamforming weights may be adapted as described above based on the noise output by the loudspeaker(s).

All previously discussed embodiments are not intended as limitations but serve as examples illustrating features and advantages of the invention. It is to be understood that some or all of the above described features can also be combined in different ways.

It should be recognized by one of ordinary skill in the art that the foregoing methodology may be performed in a signal processing system and that the signal processing system may include one or more processors for processing computer code representative of the foregoing described methodology. The computer code may be embodied on a tangible computer readable medium i.e. a computer program product.

The present invention may be embodied in many different forms, including, but in no way limited to, computer program logic for use with a processor (e.g., a microprocessor, microcontroller, digital signal processor, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an embodiment of the present invention, predominantly all of the reordering logic may be implemented as a set of computer program instructions that is converted into a computer executable form, stored as such in a computer readable medium, and executed by a microprocessor within the array under the control of an operating system.

Computer program logic implementing all or part of the functionality previously described herein may be embodied in various forms, including, but in no way limited to, a source code form, a computer executable form, and various intermediate forms (e.g., forms generated by an assembler, compiler, networker, or locator.) Source code may include a series of computer program instructions implemented in any of various programming languages (e.g., an object code, an assembly language, or a high-level language such as Fortran, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies, networking technologies, and internetworking technologies. The computer program may be distributed in any form as a removable storage medium with accompanying printed or electronic documentation (e.g., shrink wrapped software or a magnetic tape), preloaded with a computer system (e.g., on system ROM or fixed disk), or distributed from a server or electronic bulletin board over the communication system (e.g., the Internet or World Wide Web.)

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL.)

What is claimed is:

1. A method for signal processing in a signal processing system comprising the steps of:

obtaining a first plurality of microphone signals by a first microphone array;

obtaining a second plurality of microphone signals by a second microphone array different from the first microphone array;

beamforming the first plurality of microphone signals by a first beamformer comprising beamforming weights to obtain a first beamformed signal;

beamforming the second plurality of microphone signals by a second beamformer comprising the same beamforming weights as the first beamformer to obtain a second beamformed signal; and adjusting the beamforming weights such that the power density of echo components and/or noise components present in the first and second plurality of microphone signals is substantially reduced.

2. The method according to claim 1, wherein the beamforming weights are adjusted such that the power density of the sum of the first and the second beamformed signals is substantially reduced.

3. The method according to claim 1, wherein the beamforming weights are adjusted such that the sum of the power density of the first beamformed signal and the power density of the second beamformed signal is substantially reduced.

4. The method according to claim 1, wherein the beamforming weights are adjusted by a non-linear least mean square algorithm observing the condition that the L2 norm of the vector of the beamforming weights is greater than zero.

5. The method according to claim 1, wherein the beamforming weights are adjusted by a non-linear least mean square algorithm observing the condition that the power transfer function of the first and the second beamformers for a predetermined frequency range and a predetermined range of spatial angles does not fall below a predetermined limit.

6. The method according to claim 1, wherein the first and the second microphone arrays are sub-arrays of a third microphone array and the first and second plurality of microphone signals are selected from a third plurality of microphone signals obtained by the third microphone array and wherein, in particular, the first plurality of microphone signals comprises at least one microphone signal of the second plurality of microphone signals.

7. A method according to claim 1 further comprising:

determining the speaker's direction towards and/or distance from the first and/or second microphone arrays on the basis of the first and/or second beamformed signals.

8. Signal processing means, comprising:

a first microphone array configured to obtain a first plurality of microphone signals;

a second microphone array different from the first microphone array and configured to obtain a second plurality of microphone signals;

a first beamformer comprising beamforming weights and configured to beamform the first plurality of microphone signals to obtain a first beamformed signal;

a second beamformer comprising the same beamforming weights as the first beamformer and configured to beamform the second plurality of microphone signals to obtain a second beamformed signal; and a control means configured to adjust the beamforming weights such that the power density of echo components and/or noise components present in the first and/or second plurality of microphone signals is minimized.

9. The signal processing means according to claim 8, wherein the control means is configured to adjust the beamforming weights by minimizing the power density of the sum of the first and the second beamformed signals or by minimizing the sum of the power density of the first beamformed signal and the power density of the second beamformed signals.

10. The signal processing means according to claim 8, wherein the first and second beamformers are chosen from the group consisting of an adaptive filter-and-sum beamformer, a linearly constrained minimum variance beamformer, in particular, a minimum variance distortionless response beamformer, and a differential beamformer.

11. A communication system adapted for the localization of a speaker, the communication system comprising:

a first microphone array configured to obtain a first plurality of microphone signals;

a second microphone array different from the first microphone array and configured to obtain a second plurality of microphone signals;

a first beamformer comprising beamforming weights and configured to beamform the first plurality of microphone signals to obtain a first beamformed signal;

a second beamformer comprising the same beamforming weights as the first beamformer and configured to beamform the second plurality of microphone signals to obtain a second beamformed signal;

a control means configured to adjust the beamforming weights such that the power density of echo components and/or noise components present in the first and/or second plurality of microphone signals is minimized; and a processing means configured to determine the speaker's direction towards and/or distance from the first and/or second microphone arrays on the basis of the first and/or second beamformed signals.

12. A communication system according to claim 11 wherein the communication system is a hands-free communication device.

* * * * *